US006321950B1

(12) United States Patent
Muis

(10) Patent No.: US 6,321,950 B1
(45) Date of Patent: Nov. 27, 2001

(54) PORTABLE ALL-ENCOMPASSING HAND AND MULTI-PURPOSE ATOMIZING DISPENSER

(76) Inventor: Robert Chris Muis, 2442 S. Ridge Ave., Bullhead City, AZ (US) 86429

( * ) Notice: Subject to any disclaimer, the term of this patent is extended or adjusted under 35 U.S.C. 154(b) by 0 days.

(21) Appl. No.: 09/627,227

(22) Filed: Jul. 27, 2000

(51) Int. Cl.[7] ..... B65D 88/54
(52) U.S. Cl. ..... 222/321.8; 222/505
(58) Field of Search ..... 222/321.1, 321.8, 222/325, 505, 515

(56) References Cited

U.S. PATENT DOCUMENTS 4,264,037 * 4/1981 Nozawa ..... 222/321.8
4,264,038 * 4/1981 Nozawa ..... 222/321.8
5,482,187 * 1/1996 Poulsen et al. ..... 222/321.8

* cited by examiner

*Primary Examiner*—Philippe Derakshani
*Assistant Examiner*—Thach H Bui

(57) ABSTRACT

An all-encompassing atomizing dispenser device consisting of a vertical standing tube or container, chassis, and a bottle holder insert-clip, comprising a conventional spray bottle with a standard fine mist spray nozzle fixed in one basic direction for atomizing various liquids for multiple applications. The user can simply place a hand down into the opening of the device, tilt or press lightly with the palm by applying pressure on the bottle holder insert-clip, which instantaneously atomizes the hand within the all-encompassing dispenser. The bottle holder insert-clip can be easily removed in order that the conventional spray bottle may be filled with user's choice of liquid. This invention resolves the inconvenience of handling a conventional spray bottle by passing it from one hand to another. It may be placed on a flat surface and is of convenient size to be transported from one location to another.

23 Claims, 5 Drawing Sheets

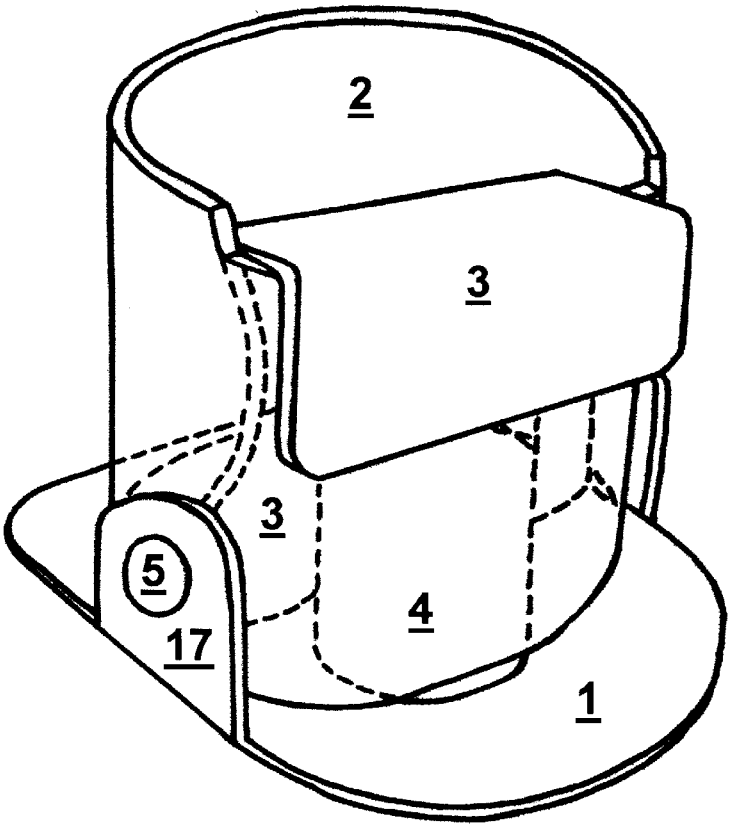
FIG. 1
FIG. 2
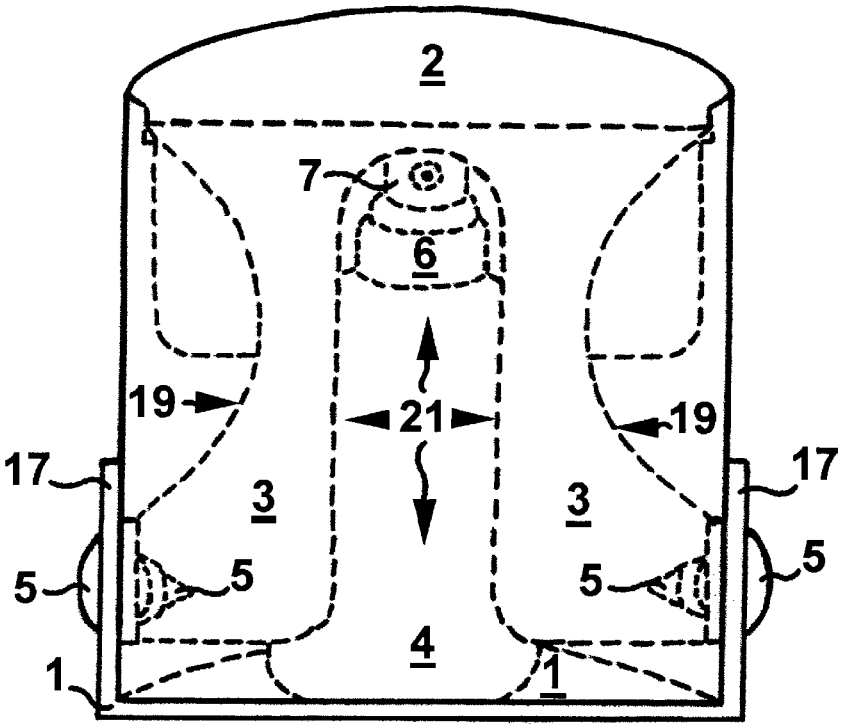

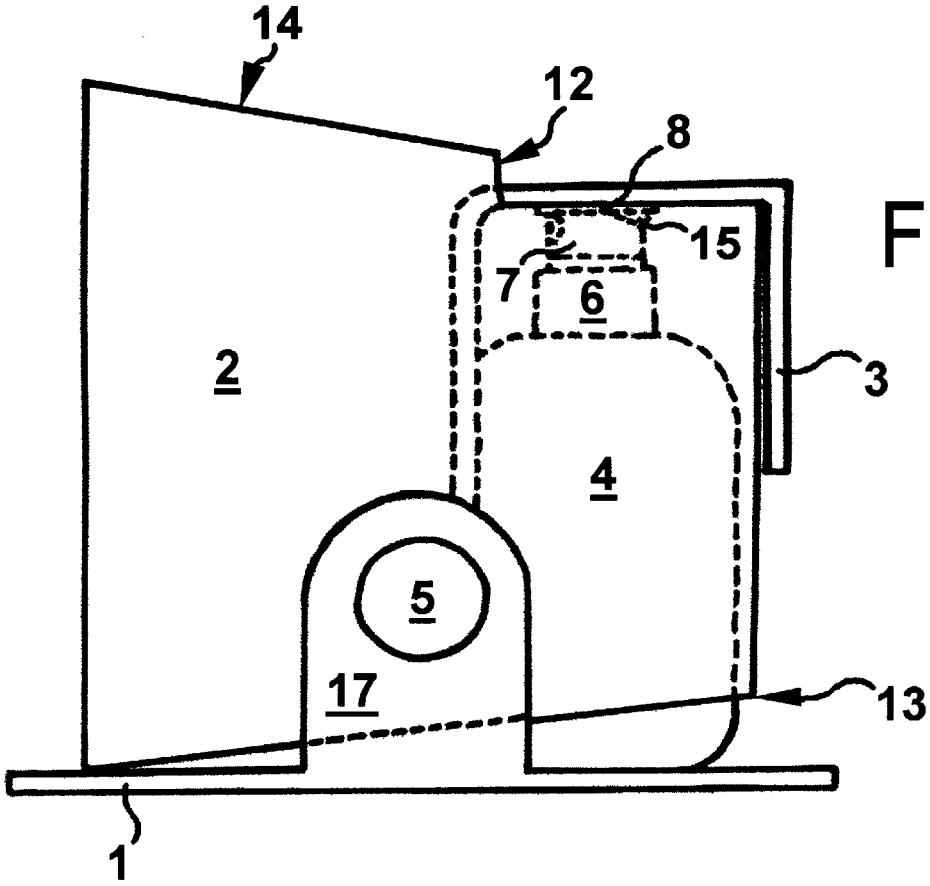
FIG. 3
FIG. 4
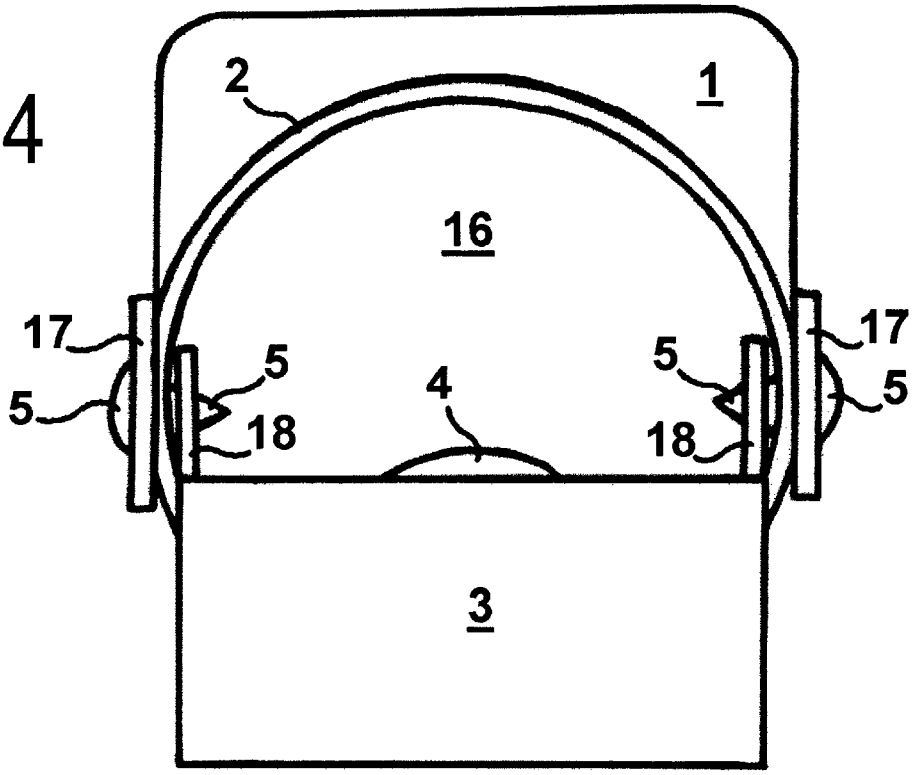

PORTABLE ALL-ENCOMPASSING HAND AND MULTI-PURPOSE ATOMIZING DISPENSER

BACKGROUND OF THE INVENTION

This invention relates to a multi-purpose all-encompassing dispenser device for individuals for use at home or in the workplace in order to atomize the user's hands or any other object that will fit within the dispenser using a quick press-to-clean action with a presto clean result.

Conventionally, a bottle with a spray nozzle and pump or lever is used by an individual to atomize their hands or other objects by holding a spray bottle in one hand, while with that hand's index finger, manually press a nozzle or squeeze a trigger, to disperse a mist or spray onto the opposite hand or object of choice. However, this procedure in certain instances, is an inconvenience, where the user must take an unreasonable amount of time to transfer the traditional spray bottle from one hand to the other in order to atomize his or her hands properly. Further, for the users with carpal tunnel, arthritis, or any other debilitating problems, using a conventional spray bottle in this fashion can be painful or difficult to use.

It is against this background, and the desire to solve the problems of the prior art, that the present invention has been developed.

There are no patents or any other prior art disclosing a portable and all-encompassing atomizing dispenser in which the user need only place their hand inside the device and press down lightly in a slight tilting action with their palm to disperse a fine mist. Whereas, the user wishes to spray a small object, the object may be placed into the dispenser and atomized. This device, designed for speed, comfort, as well as convenience, may be placed upon any relatively level and firm surface to stand on its own, hang on a wall, or can be easily transported from one location to another.

SUMMARY OF THE INVENTION

Accordingly, it is an object that the present invention provide a multi-purpose all-encompassing dispenser that would accompany a conventional spray bottle of particular size in which various liquids may disperse a fine mist for certain types of anti-bacterial formulas, fragrances, sun tanning lotions, lubricants, or whatever the user may deem needed, and at the same time, would keep the spray nozzle of the conventional spray bottle used in each device fixed in one basic direction. Further, the device directs all spraying within a confined area, unlike the over-spraying of a conventional spray bottle.

It is further object to provide quick and easy usage by placing one's hand down into the vertical dispenser and simply tilt, pressing the palm lightly to disperse the liquid onto the user's hand, or inserting an object of appropriate size, for instance, musical instrument mouth pieces, microphones, and utensils, that may also need atomizing.

It is even further object to provide a portable all-encompassing atomizing dispenser in order that the user may place the device on a counter top or desk hang it on a wall, carry the device in their vehicle for usage, or simply transport it at all times.

The above and other objects and advantages of this invention are pointed out with particularity in the claims annexed hereto and forming a part hereof. However, for a better understanding of the invention, the advantages, and the objects obtained by its use, the following drawings which form a further part hereof, should be referenced in which there is illustrated and described preferred embodiments of the invention.

BRIEF DESCRIPTION OF THE DRAWINGS

The accompanying drawings, which are incorporated in and form a part of the specification, illustrate the preferred embodiment of the present invention, and together with the descriptions, serve to explain the principles of the invention.

FIG. 1 is a perspective view of the preferred embodiment of the present invention depicting the device in its entirety.

FIG. 2 is a perspective back view of the preferred embodiment of the present invention showing the parts within the device.

FIG. 3 is a perspective side view of the preferred embodiment of the present invention showing the parts within the device.

FIG. 4 is a top view thereof showing the opening of the device in which a hand or other objects may be inserted.

DETAILED DESCRIPTION OF THE PREFERRED EMBODIMENT

Figure 5:
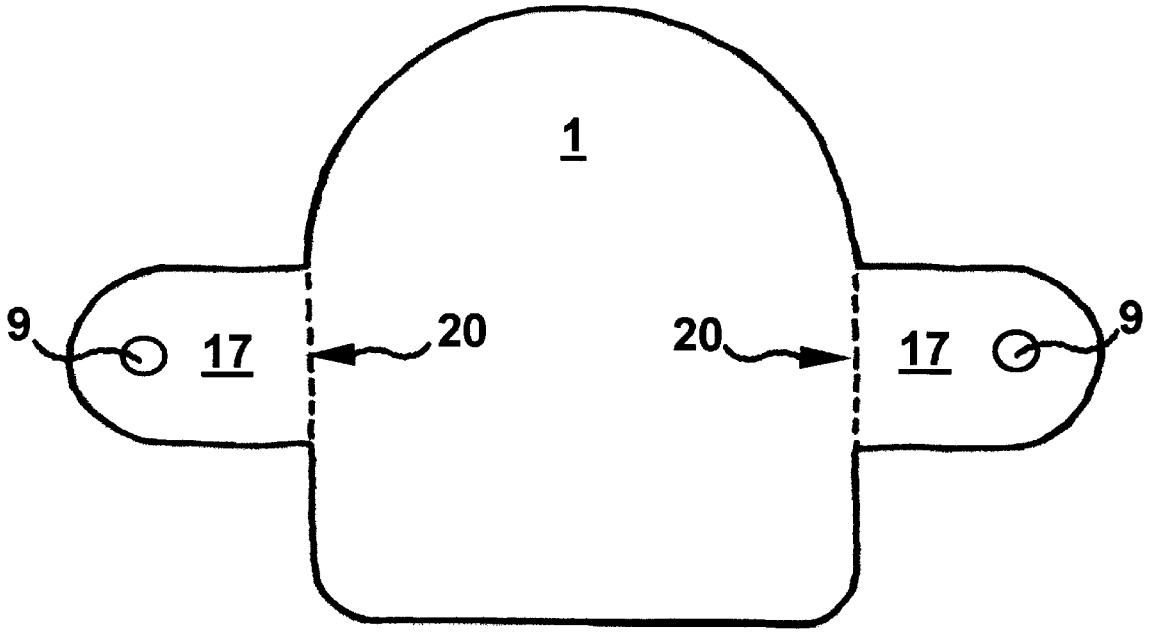
FIG. 5 is a template or flat view of the chassis of the present invention.
Figure 6:
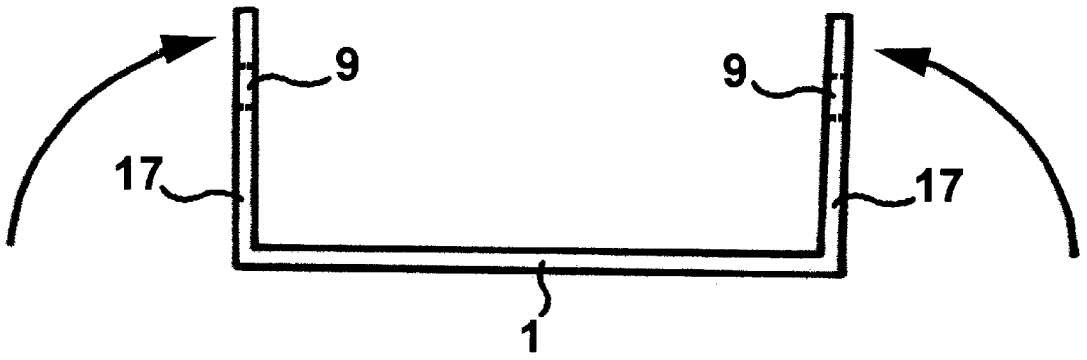
FIG. 6 is a front view of the chassis after the tabs have been formed into the proper configuration.

Referring now to the drawings, in particular to FIGS. 1 through 11, a portable all-encompassing hand and multi-purpose atomizing dispenser device comprising the following detailed preferred embodiment as illustrated:

A chassis 1 fabricated of a clear acrylic plastic flat-stock material comprising two tabs 17, which are, formed into an upright position at the fold lines 20 as illustrated in FIGS. 5 and 6. Centered and positioned closer to the top edge of each tab 17 is a circular hole 9 as illustrated in FIG. 5.

Figure 10:
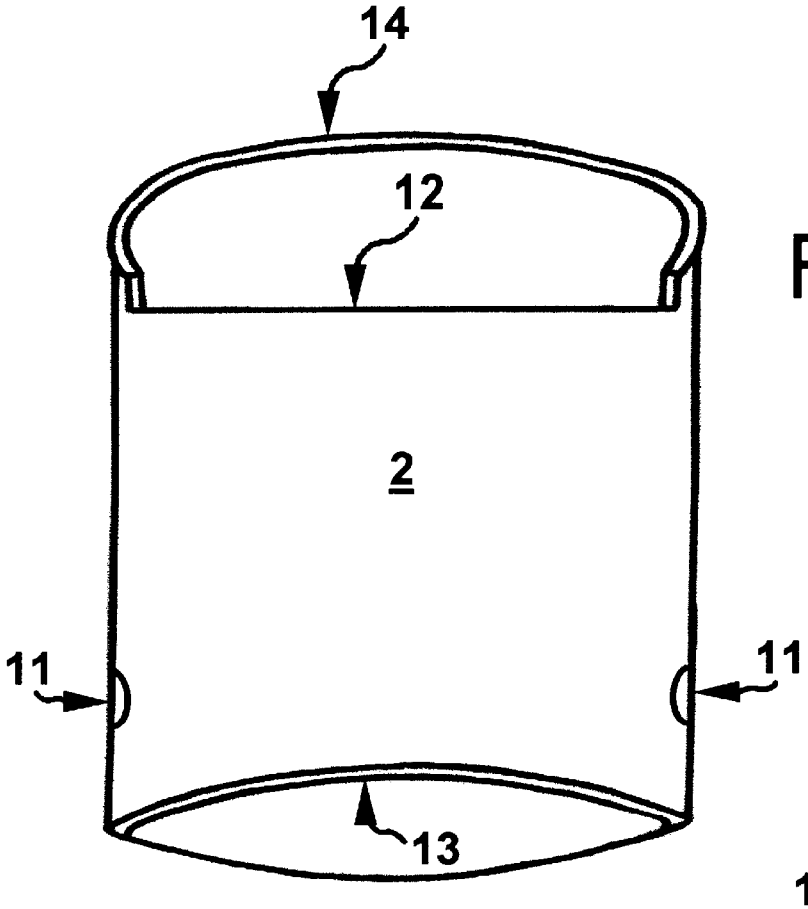
FIG. 10 is a perspective front view of the dispenser tube used in the present invention.
Figure 11:
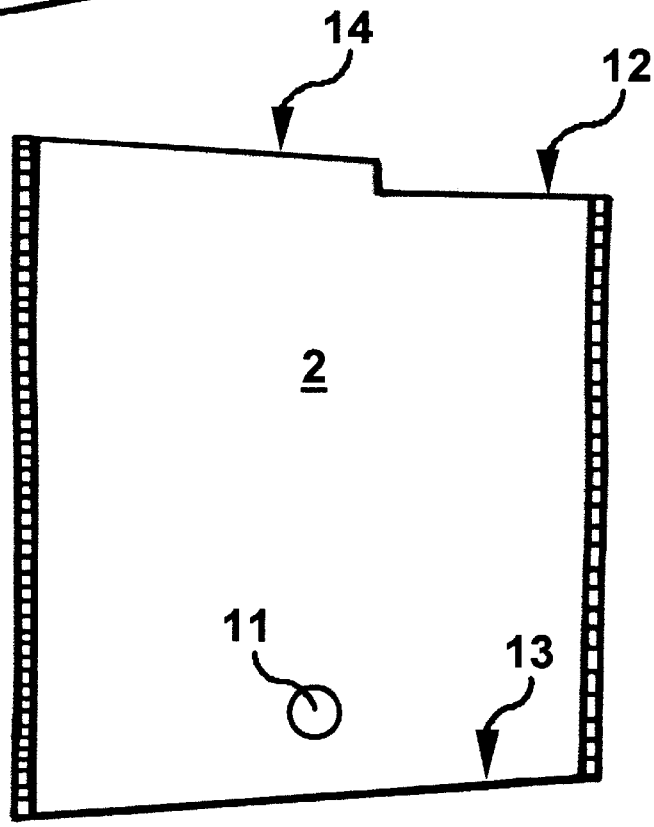
FIG. 11 is a cut-in-half side view of the dispenser tube used in the present invention.

A clear dispenser tube 2 fabricated of a clear acrylic plastic tube comprising an angle cut 13 on the bottom edge to serve as the area needed when the device is tilted with the user's palm, therefore, engaging the spray nozzle spring apparatus 6 to release the atomizing mist onto the user's hand. The same angle cut 14 is placed on the top edge in order to better encompass the atomizing mist, in which also a wedge cut 12 is incorporated into the top angle cut 14, as illustrated in FIG. 1. The wedge cut 12 is used to properly seat the bottle holder insert-clip 3 onto the dispenser tube 2 as illustrated in FIGS. 1 through 4. Approximately 1' from the bottom of the dispenser tube 2 are two circular holes 11 placed directly across from each other at each side as illustrated in FIGS. 10 and 11.

Figure 7:
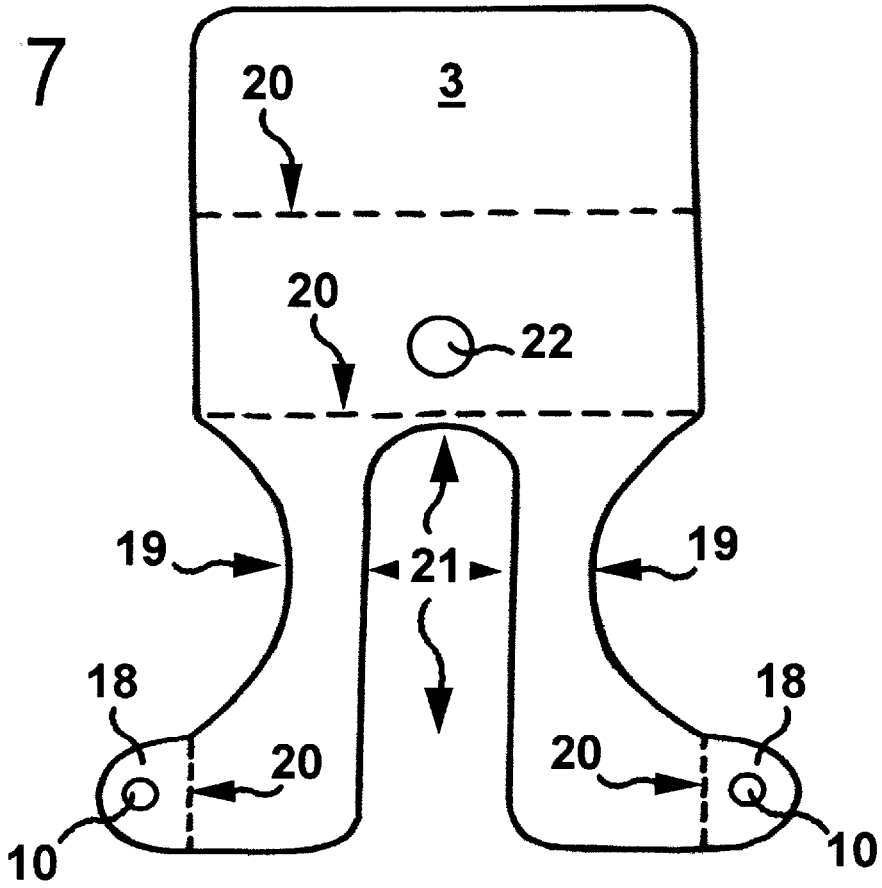
FIG. 7 is a template or flat view of the bottle holder insert-clip of the present invention.
Figure 8:
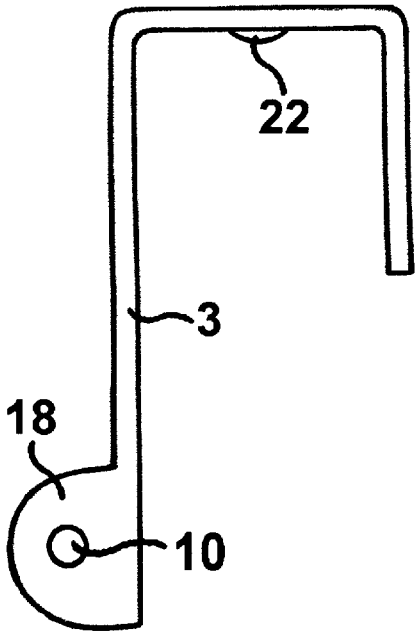
FIG. 8 is a side view of the bottle holder inserthip after tabs and insert-clip itself has been formed into the proper configuration.

A bottle holder insert-clip 3 fabricated of a clear flexible non-breakable plastic flat-stock material comprising two flex-rip arms 19, two tabs 18 with a circular hole 10 centered at the end of each tab 18, and a hoop and loop fastener 22, (preferably the hook side), centered onto the bottle holder insert-clip 3 just above the bottle window 21 as illustrated in FIG. 7. The bottle holder insert-clip 3 is formed at fold lines 20 illustrated in FIG. 7 to appropriate size, FIG. 8, in order to accommodate an atomizing cylinder shaped bottle 4. The atomizing cylinder shaped bottle 4 comprises hook and loop fastening means 8, (preferably the loop side), affixed onto the top of the spray nozzle 7 with high temp hot-melt glue 15 which adheres the spray nozzle 7 on to the bottle holder insert-clip 3 as illustrated in FIG. 3, and most importantly, to place the spray nozzle 7 in one fixed direction at all times. The bottle window 21 is of appropriate width and height in accordance with the atomizing cylinder shaped bottle 4 in order to hold the atomizing cylinder shaped bottle 4 firmly against the dispenser tube 2 wall and expose the spray nozzle 7 as illustrated in FIG. 2 and 3.

Figure 9:
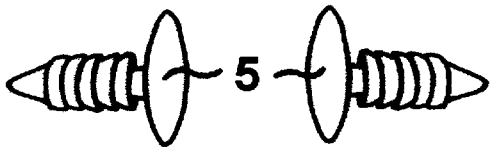
FIG. 9 is a perspective view of the push-on fasteners used in the present invention, which hold the chassis, dispenser tube, and bottle holder insert-clip together.

Two push-on fasteners 5, FIG. 9, comprised of plastic in an appropriate size are permanently inserted into the chassis tab holes 9 and the dispenser tube holes 11 which are of a smaller size than the bottle holder insert-clip tab holes 10. Then, in order to place the bottle holder insert-clip 3 into the dispenser tube 2, the user need only pinch the flex-grip arms 19 together slightly while placing the bottle holder insert-clip 3 into the tube dispenser 2 and lining up the bottle holder insert-clip tab holes 10 with the push-on fasteners 5, then release the flex-grip arms 19 which will snap the bottle holder insert-clip tab holes 10 onto the push-on fasteners 5. FIG. 2 illustrates a side view of the push-on fasteners 5 inserted into all of the tab holes 9, 10, and 11. The bottle holder insert-clip tab holes 10 are slightly larger in size in order that the bottle holder insert-clip 3 may be easily removed and inserted into the dispenser tube 2 so that the atomizing cylinder shaped bottle 4 may be refilled with choice of liquid when needed.

FIG. 4 depicts the top view of the preferred embodiment illustrating the open area in which the user's hand is to be inserted 16 resting the palm onto the bottle holder insert-clip 3. The user then would tilt their palm down applying pressure, ever so slight, on bottle holder insert-clip 3 tilting the dispenser tube 2 forward, therefore, forcing the liquid filled atomizing cylinder shaped bottle 4 upward to activate the spray nozzle spring apparatus 6 and release a fine mist on the user's hand.

However, it is to be understood, that even though numerous advantages and characteristics of the present invention have been set forth in the foregoing description, together with the function and details of the invention, the disclosure is illustrative only, and changes may be made in detail pertaining to size, shape, materials, parts, and arrangements of parts, falling within the scope of the invention.

Having thus described my invention, I claim:

1. A portable all-encompassing hand and multi-purpose atomizing dispenser device in which the user can simply place his or her hand into the dispenser tube, tilt and press lightly with their palm against the bottle holder insert-clip, instantaneously atomizing their hand or object with a choice of liquid, comprising:

a) a cylinder or tube dispenser fabricated of a dear acrylic plastic type material with an approximate angle cut of ½" on both ends and a straight wedge cut incorporated into the top angle cut in order to hold the bottle holder insert-clip into place;

b) a flat chassis fabricated of an acrylic plastic type material having two tabs bent in an upright position with appropriate spacing to house the dispenser tube;

c) a removable bottle holder insert-clip fabricated of a non-breakable flexible plastic material having two flex-grip arms, two tabs, a bottle window, and hook and loop fastening means, (preferably the hook side), in order to affix the spray nozzle in one direction at all times and hold the atomizing cylinder shaped bottle in place;

d) holes of appropriate size on each side of the dispenser tube and chassis tabs to permanently lock in push-on fasteners;

e) holes of appropriate size in the bottle holder insert-clip tabs which are slightly larger than the push-on fasteners in order that the bottle holder insert-clip may be removed with ease;

f) push-on fasteners fabricated of plastic that are inserted into the chassis tab holes and dispenser tube holes, permanently holding the two components together while functioning as hinges;

g) any standard atomizing cylinder shaped bottle with a spray nozzle spring apparatus of appropriate size to fit within the bottle holder insert-clip;

h) a spray nozzle comprising hook and loop fastening means, (preferably the loop side), adhered to the top of the spray nozzle with a high-temp hot melt glue in order that the spray nozzle may be placed into the bottle holder insert-clip and affixed to the hook and loop fastening therein, holding the spray nozzle in one fixed direction.

2. A portable all-encompassing hand and multi-purpose atomizing dispenser device as in claim 1, wherein said cylinder or tube dispenser comprises the same angle cut on top as on the bottom allowing the bottle holder insert-slip to rest upon the angle cut.

3. A portable all-encompassing hand and multi-purpose atomizing dispenser device as in claim 1, wherein said cylinder or tube dispenser comprises a straight cut on both ends.

4. A portable all-encompassing hand and multi-purpose atomizing dispenser device as in claim 1, wherein said chassis is round with edging resembling a cap comprising a slotted hole on each side in place of the tab holes.

5. A portable all-encompassing hand and multi-purpose atomizing dispenser device as in claim 1, wherein said fasteners are of an acrylic plastic material post or tab incorporated within and being a part of the chassis tabs.

6. A portable all-encompassing hand and multi-purpose atomizing dispenser device as in claim 1, wherein said fasteners are of an acrylic plastic material post or tab incorporated within and being a part of the bottle holder insert-clip tabs that snap into the holes of the dispenser tube and chassis tabs.

7. A portable all-encompassing hand and multi-purpose atomizing dispenser device as in claim 1, wherein said fasteners are nylon or metal screws.

8. A portable all-encompassing hand and multi-purpose atomizing dispenser device as in claim 1, wherein said hook side of fastening means on the bottle holder insert-clip is replaced with an indented tab which fits onto the spray nozzle in order to position the spray nozzle in one fixed direction.

9. A portable all-encompassing hand and multi-purpose atomizing dispenser device as in claim 1, wherein said spray nozzle comprises hook and loop fastening means adhered to the top of the spray nozzle with glue provided on the hook and fastening means.

10. A portable all-encompassing hand and multi-purpose atomizing dispenser device as in claim 1, wherein said spray nozzle is permanently affixed with hot-melt glue.

11. A portable all-encompassing hand and multi-purpose atomizing dispenser device as in claim 10, wherein said spray nozzle is permanently affixed with a push-on fastener.

12. A portable all-encompassing hand and multi-purpose atomizing dispenser device as in claim 11, wherein said spray nozzle is permanently affixed with a nylon or metal screw.

13. A portable all-encompassing hand and multi-purpose atomizing dispenser device as in claim 12, wherein said spray nozzle is permanently affixed with a nylon or metal screw and glue.

14. A portable all-encompassing hand and multi-purpose atomizing dispenser device as in claim 11, wherein said spray nozzle is permanently affixed with a push-on fastener and glue.

15. A portable all-encompassing hand and multi-purpose atomizing dispenser device as in claim 10, wherein said spray nozzle is permanently affixed with a riveting means.

16. A portable all-encompassing hand and multi-purpose atomizing dispenser device as in claim 1, wherein said spray nozzle is an acrylic plastic material incorporated within and being a part of the bottle holder insert-clip.

17. A portable all-encompassing hand and multi-purpose atomizing dispenser device in which the user can simply place his or her hand into the dispenser tube, tilt and press lightly with their palm against the flattened top of the dispenser tube, instantaneously atomizing their hand or object with choice of liquid, comprising:

a) a cylinder or tube dispenser fabricated of an acrylic plastic material with an approximate angle cut of ½" on the bottom and a swedged or flattened down portion on the top front of the dispenser tube in which the user rests their palm to tilt and press the device;

b) a chassis fabricated of an acrylic plastic material having two tabs, comprising a hole in each tab, bent in an upright position with appropriate spacing to house the dispenser tube;

c) a plastic or metal rod that is inserted and adhered into the dispenser tube extending through the dispenser tube serving as a peg or tab, at each side, to be inserted into the chassis tab holes;

d) any standard atomizing cylinder shaped bottle with spray nozzle spring apparatus of appropriate size to fit within the space of the dispenser tube wall and the rod;

e) a spray nozzle comprising hook and loop fastening means adhered to the underneath side of the swedged or flattened down portion of the dispenser tube, therein, placing the spray nozzle in one fixed direction.

18. A portable all-encompassing hand and multi-purpose atomizing dispenser device as in claim 17, wherein said cylinder or tube dispenser swedged or flattened down area is replaced with a cap comprising an appropriate sized cut-out and then is affixed to the top of the cylinder or tube dispenser providing a place for the user to rest their palm and to affix the spray nozzle from the underneath side.

19. A portable all-encompassing hand and multi-purpose atomizing dispenser device as in claim 18, wherein said cap is a half-moon cut piece of an acrylic plastic material adhered onto the top of the dispenser tube.

20. A portable all-encompassing hand and multi-purpose atomizing dispenser device comprising:

a) a container or jar in appropriate shape and size to fit a user's hand, preferably cylindrical, sealed on the bottom side of said container or jar and open on the top side of said container or jar, fabricated of a non-breakable light-weight plastic material;

b) further comprising a removable bottle holder insert-clip, fabricated of a non-breakable light-weight plastic material, with a first hole in said insert-clip's bottom tab in appropriate size to house a standard spray bottle of particular size, a second hole or opening placed in said insert-clip at a position to expose a spray nozzle, and a tab of appropriate size at the top of said insert-clip where a user places their palm and presses down, engaging a spray nozzle spring apparatus;

c) further comprising any standard atomizing cylinder shaped bottle with a spray nozzle and spray nozzle spring apparatus of appropriate size to fit within said bottle holder insert-clip;

d) further comprising hook and loop fastening means adhered to said spray nozzle and said bottle holder insert-clip, therefore, holding said spray nozzle in one fixed direction;

e) further comprising a lid, fabricated of a non-breakable light-weight plastic material, fitted to said container or jar, comprising an opening in said lid in appropriate size to fit a user's hand and properly retain said bottle holder insert-clip.

21. A portable all-encompassing hand and multi-purpose atomizing dispenser device as in claim 20, wherein said bottle holder insert-clip comprises a spray nozzle enclosure holding said spray nozzle in one fixed direction.

22. A portable all-encompassing hand and multi-purpose atomizing dispenser device as in claim 20, wherein said container or jar comprises a compartment with a fitted spray nozzle spring apparatus, wherein, a dispensing liquid is filled.

23. A portable all-encompassing hand and multi-purpose atomizing dispenser device as in claim 20, wherein said lid is loose, and not fitted, therefore, when placed onto said jar or container, said lid can move freely up and down, comprising a shelf with a molded spray nozzle underneath, where a user places their palm and presses down, engaging said spray nozzle spring apparatus.

* * * * *